US005795504A

United States Patent [19]

Berchotteau

[11] Patent Number: 5,795,504

[45] Date of Patent: Aug. 18, 1998

[54] APPARATUS FOR FEEDING AND DIFFUSING AIR OR ANOTHER GAS INTO A LIQUID

[76] Inventor: Raymond Berchotteau, 9, rue Linne, 78500 Sartrouville, France

[21] Appl. No.: 518,548

[22] Filed: Aug. 23, 1995

Related U.S. Application Data

[63] Continuation-in-part of PCT/FR94/00198 Feb. 23, 1994 published as WO94/20200 Sep. 15, 1994.

[30] Foreign Application Priority Data

Mar. 5, 1993 [FR] France ..... 93 02602

[51] Int. Cl.[6] ..... B01F 3/04

[52] U.S. Cl. ..... 261/30; 261/77; 261/85; 261/86; 261/87

[58] Field of Search ..... 261/30, 77, 79.1, 261/85, 86, 87, 20

[56] References Cited

U.S. PATENT DOCUMENTS

| | | | |
|---|---|---|---|
| 1,779,181 | 10/1930 | McDonald . | |
| 2,743,914 | 5/1956 | Epprecht . | |
| 3,400,918 | 9/1968 | MacLaren . | |
| 4,188,287 | 2/1980 | Faulkner et al. | 261/87 |
| 4,283,357 | 8/1981 | Sidery | 261/87 |
| 4,426,068 | 1/1984 | Gimond et al. | 261/87 |

FOREIGN PATENT DOCUMENTS

| | | | |
|---|---|---|---|
| 559622 | 1/1958 | Belgium . | |
| 530839 | 9/1992 | European Pat. Off. . | |
| 1933769 | 2/1970 | Germany . | |
| 52-7066 | 1/1977 | Japan . | |
| 738649 | 6/1980 | U.S.S.R. | 261/87 |
| WO91/05582 | 5/1990 | WIPO . | |

*Primary Examiner*—Khanh P. Nguyen
*Attorney, Agent, or Firm*—Horst M. Kasper

[57] ABSTRACT

An apparatus includes a hollow shaft (6) with water jet vacuum pumps peripherally attached to the end thereof at a certain distance therefrom wherein the water pumps have vacuum pockets (3) communicating with the inside of the hollow shaft via ducts (5). The lower portion of the shaft is plugged, and its upper portion has peripheral perforations (8) providing free access for air or gas flowing into the shaft so that the air or gas can reach the vacuum pockets of the water pumps. The top end of the shaft is coupled to an electric motor (9) either directly or via a motor reducer (10). When the shaft and the water pumps are rotating within a liquid, the liquid pressure at the tips (2) of the water pumps create a vacuum, whereby fine bubbles of air or gas can be fed into and diffused through the liquid at a submerged depth of the water pumps.

17 Claims, 4 Drawing Sheets

APPARATUS FOR FEEDING AND DIFFUSING AIR OR ANOTHER GAS INTO A LIQUID

CROSS-REFERENCE TO RELATED APPLICATIONS

This application is a continuation-in-part application of another international application filed under the Patent Cooperation Treaty on Feb. 23, 1994, bearing application No. PCT/FR94/00198 now WO 94/20200 and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to an apparatus for introducing and diffusing air or some other gas into a liquid.

2. Background of the Invention

The introduction and diffusion of air into a liquid is currently achieved using compressors, blowers, turbines, which supply air under pressure; pipes transport the air thus compressed towards the point of use, perforated tubing, diffusers or other systems producing bubbles of greater or lesser size to be brought into contact with the liquid.

Surface turbines are also used, they spray the liquid into the atmosphere in order to bring it into contact with air at atmospheric pressure.

Other types of turbines are immersed, with their electric drive motors located in a sealed enclosure, the turbine being connected to the outside of the liquid by a pipe, the electric motor by cables with sealed connection. These turbines allow air or gas to be introduced into a liquid.

The water jet vacuum pumps are mounted statically on pipes under pressure, they allow air or any other gas to be introduced into the liquid passing through the water jet vacuum pump.

Diffusing a gas into a liquid by drawing gas into the liquid by "venturi effect" is known, the venturi effect being created by the rotation about a shaft of elements immersed in the liquid and which comprise a convergent/divergent nozzle with a gas inlet at the throat thus created. As the elements rotate, the gas is drawn in at the throat and is dispersed into the liquid (e.g. see the U.S. Pat. No. 2,743,914 and WO 90/05582).

SUMMARY OF THE INVENTION

The invention relates to an apparatus for diffusing air or some other gas into a liquid at a certain depth, comprising a shaft, the upper end of which is mechanically connected to a rotational drive member. The shaft is equipped at its base with several water jet vacuum pumps arranged peripherally at some distance from the axis of the shaft and fixed to this shaft by supports. Each water jet vacuum pump includes, coaxially, an outlet nozzle and a cone exhibiting a tip, and a cavity in which a vacuum is created when the assembly is rotating, the cavity being connected to the source of air or of gas by ducts integral with the supports of the water jet vacuum pumps.

According to an aspect of the invention, the base of each of cones is situated in a plane including the axis of the shaft, while the outlet nozzle is substantially centrifugal.

There are two basic reasons for such an assembly:

- the liquid including the gas is ejected in a centrifugal way: this results in that the liquid including the gas is allowed to be mixed with the remaining liquid out of the processing area, and not to turn with the rotor. Consequently, the liquid including the gas is not processed by the next cone in order to avoid a local gas saturation of the liquid, and thus the efficiency of the apparatus is increased.
- the liquid input is radial in order to increase the above-mentioned effect and to help the cone penetration into the liquid. This also results in that no deformation forces are applied to the cones and to the shaft, thus the apparatus driving motor does not require over-power.

BRIEF DESCRIPTION OF THE DRAWINGS

Further objects and advantages of the invention will become apparent from the following description and claims, and from the accompanying drawings, wherein:

DESCRIPTION OF THE PREFERRED EMBODIMENTS

Figure 1:
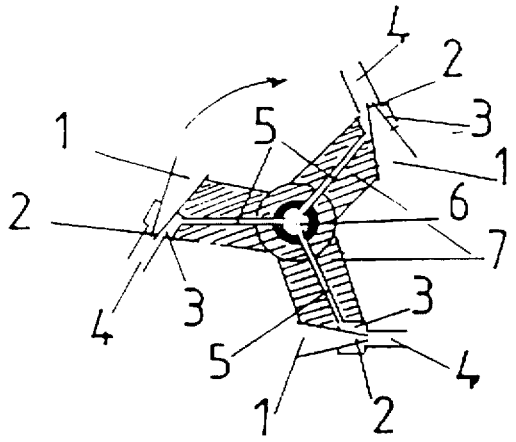
FIG. 1 is a schematic axial view of the rotating assembly according to the invention.
Figure 2:
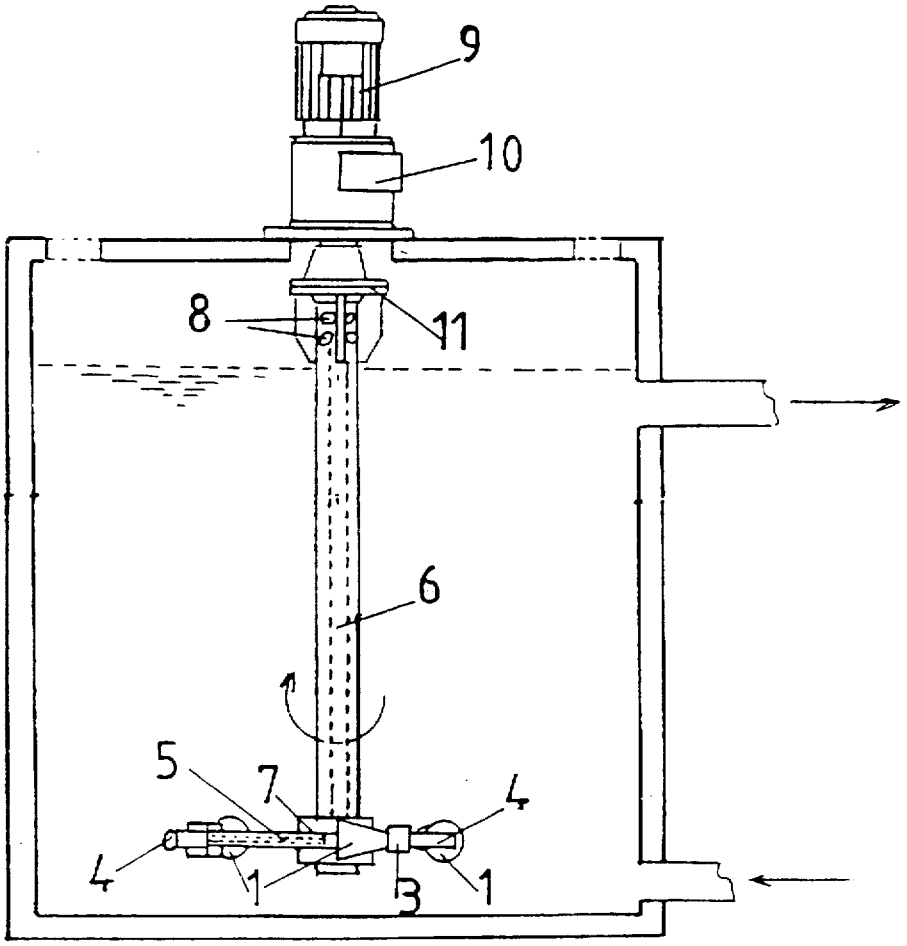
FIGS. 2, 3, 4 and 5 are cross-sectional view of preferred embodiments the invention.

Referring now to the drawings, the apparatus is composed of several water jet vacuum pumps placed in a ring configuration, and connected mechanically 7 to the base of a hollow drive shaft 6, the cavity of the water jet vacuum pumps 3, where the vacuum is created, is connected to the inside of the shaft by ducts 5 and the bottom end of the shaft is closed off. Orifices 8 are formed at the periphery, at the top part of the shaft, and the end of the shaft is coupled 11 to a drive member, an electric motor 9 in direct engagement or engaged via a geared motor unit 10, or to some other drive system.

The set of water jet vacuum pumps and part of the drive shaft are immersed vertically in a liquid, the motor 9 and the drive part being fixed to a support.

When, with the aid of a motor 9, this assembly is given a certain speed of rotation, a pressure is created at the inlet to the water jet vacuum pumps and on the tip of the cone 2 of the water jet vacuum pumps, this pressure being greater, the faster the speed of rotation in the liquid; a jet directed towards the outlet nozzle of the water jet vacuum pumps is produced at the outlet of the tip of the cones and the force of the jet in the nozzle 4 creates a vacuum in the volume 3 situated around the tips of the water jet vacuum pumps. This vacuum thus created, is communicated, via the ducts 5 situated in the supports 7, to the inside of the drive shaft 6 as far as the orifices 8 situated at the top part of the shaft. The vacuum created by the water jet vacuum pumps will thus allow air to penetrate through the orifices 8 to the inside of the hollow drive shaft 6 and then via the ducts 5 to the vacuum volume 3 of the water jet vacuum pumps and from there, the air will be drawn up by the jets of liquid leaving the tip 2 of the water jet vacuum pumps. The air will be mixed with the liquid in the outlet nozzle 4 of the water jet vacuum pumps, the air plus water mixture thus created will be diffused into the liquid of the tank or of the volume in which the apparatus is located.

A set of fan blades 18 (FIG. 3) may be fixed to the shaft above the set of water jet vacuum pumps, this making it possible to direct the liquid/air mixture leaving the nozzles 4 of the water jet vacuum pumps downwards, and to obtain mixing and vigorous homogenization of the air in the liquid.

The water jet vacuum pumps may be incorporated into the blades of a set of fan blades, and this will orientate the liquid/air mixture towards the bottom, which will allow better contact of the liquid with the air diffused into the liquid by the water jet vacuum pumps.

Figure 4:
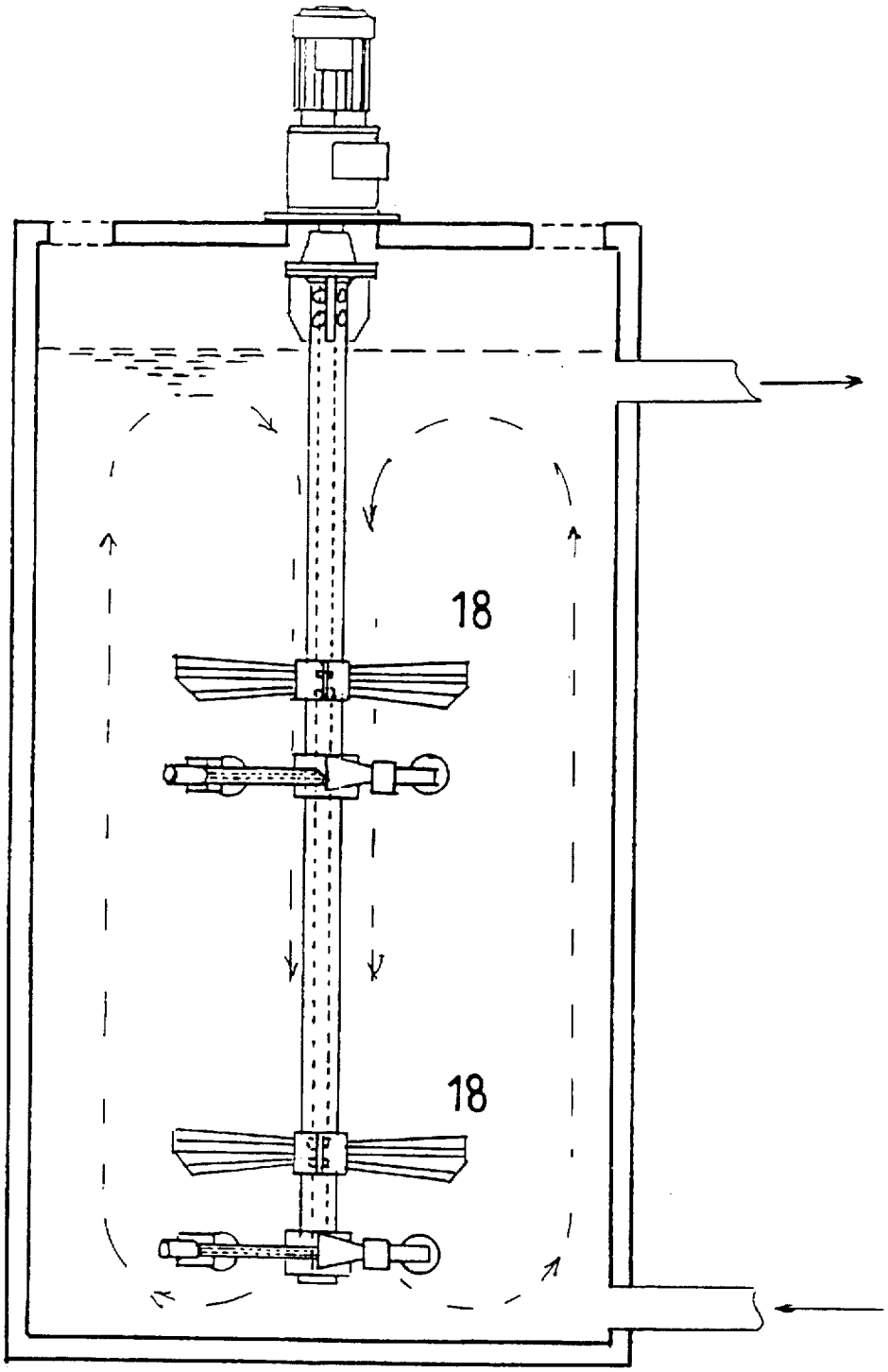
Figure 5:
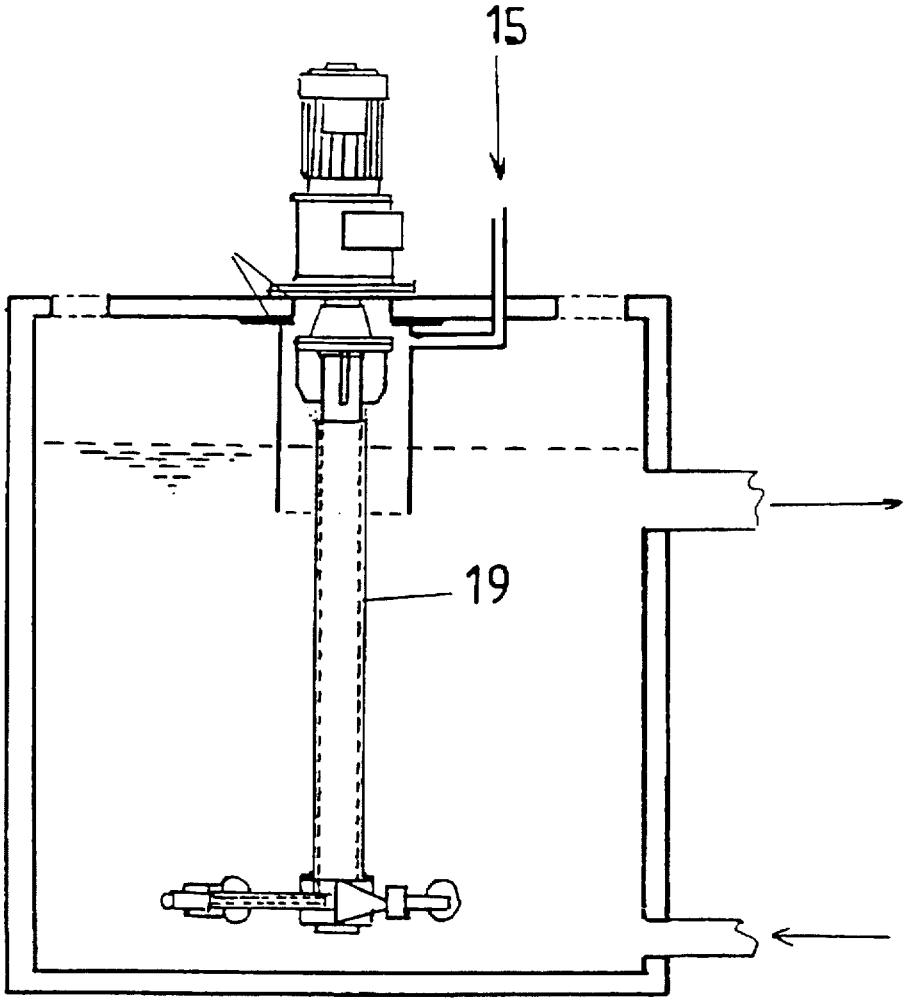

Several groups of water jet vacuum pumps may be mounted on the same shaft (FIG. 4) which may or may not be associated with sets of fan blades, this making it possible to introduce air into a liquid over a greater depth. The operation is as follows: the first set of water jet vacuum pumps which is placed the closest to the surface of the liquid will create a depression greater than the height of the liquid situated above it. The level of the liquid in the shaft will reach this first set of ejectors so as to diffuse air into the liquid. For the second set of water jet vacuum pumps to operate, it will create a depression greater than the height of liquid corresponding to the distance between the two sets of water jet vacuum pumps mounted on the same shaft, and the pressure of the air/liquid mixture leaving the nozzles of the water jet vacuum pumps must be greater than the depth of immersion in the liquid.

Several water jet vacuum pumps may be mounted on the same arm for connection to the shaft, in series, in order to increase the amount of air or gas introduced into the liquid, the vacuum volumes of the water jet vacuum pumps being connected together in series, and then connected by a duct to the inside of the drive shaft of the whole.

For the device according to the invention to operate, that is to say for the water jet vacuum pumps to begin to diffuse air into the liquid, the whole must be given a certain speed of rotation in order to obtain, on the tip of the water jet vacuum pumps, a pressure, making it possible to have in the vacuum cavity, a depression at least equal to the depth of immersion in the liquid, and a pressure at the outlet of the water jet vacuum pumps also greater than the depth of immersion.

The amount of air or of gas drawn into and diffused into the liquid by the water jet vacuum pumps will be greater, the higher the pressure on the tip of the water jet vacuum pumps, relative to the speed of rotation of the whole, therefore to the rate of penetration of the water jet vacuum pumps in the liquid.

The dispersion and diffusion of air in the liquid, that is to say the size of the bubbles, will be smaller, the greater the pressure on the tip, and therefore the greater the outlet speed from the water jet vacuum pumps, this giving better contact of the air with the liquid.

Figure 3:
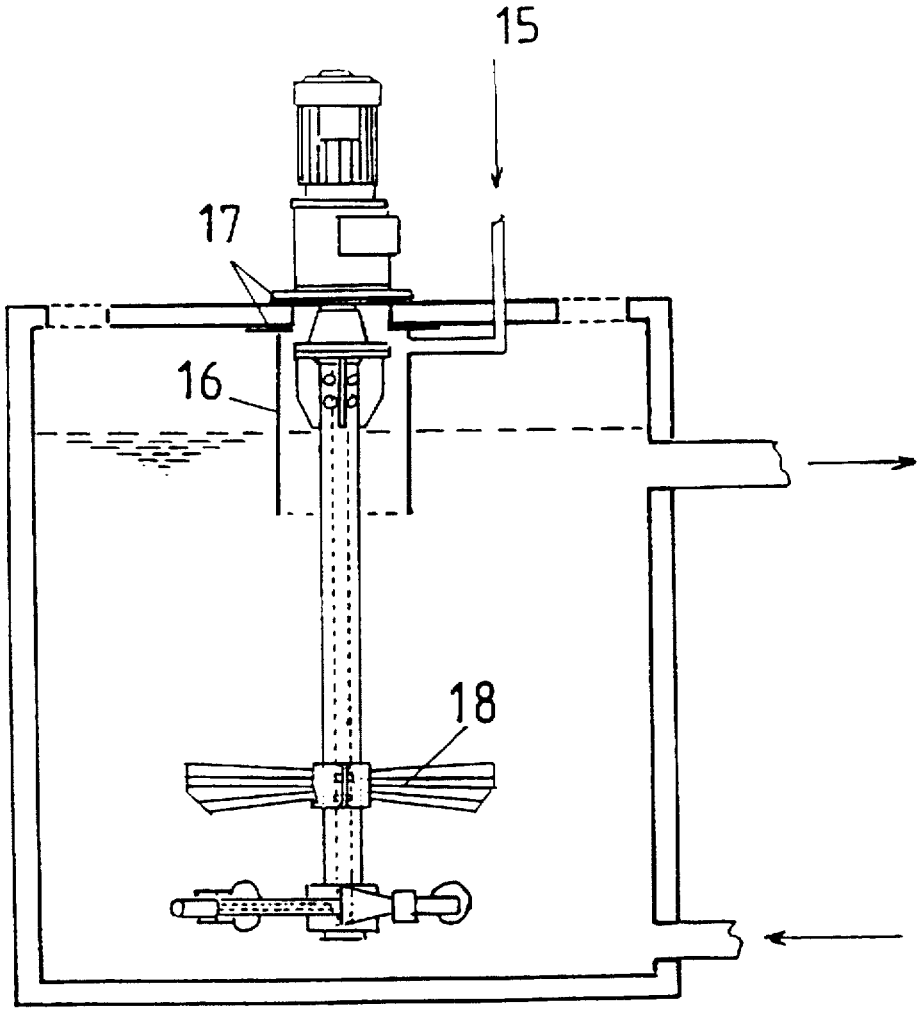

In order to use a gas other than air, with the system described hereinabove, an enclosure 16 needs to be created in line with the air inlet orifices 8 to the drive shaft, isolating them from the air as indicated in FIG. 3. A cylinder is fixed under the drive motor or under the geared motor unit 10 in a perfectly sealed manner 17, the bottom part of the cylinder dips down into the liquid and forms a hydraulic seal, on the cylinder side, and a nozzle 15 can be used to supply air or any other gas, the one which is to be diffused into the liquid, in order to subject this liquid to a specific treatment.

Depending on the gas employed, the materials used, in contact with the gas, need to be resistant to this gas or protected accordingly.

This device makes it possible, with monitoring items of apparatus placed upstream on this nozzle 15 to know very precisely the amount of gas or air diffused and introduced into the liquid.

Apparatus for diffusing air or some other gas into a liquid, at a certain depth. It is characterized by a hollow shaft 6 closed off at its lower part, orifices 8 at its upper lateral part situated above the liquid, the upper end of which is mechanically connected to the rotational drive member 9–10, this shaft is equipped at its base with several water jet vacuum pumps 1–2–3–4 arranged peripherally, some distance from the axis of the shaft and fixed to this shaft by supports, the cavity of the water jet vacuum pumps where the vacuum is created when the assembly is rotating is connected to the inside of the hollow shaft by ducts 5 integral with the supports of the water jet vacuum pumps 7.

For conveying air or gas as far as the water jet vacuum pumps, the connection with the outside is by means of a tube 19 into which the axis of the drive shaft passes, a space between the shaft and the tube allowing air or gas to pass, and the base of the tube being connected to the ducts of the supports of the water jet vacuum pumps, with the inside of the base of the tube being sealed against the liquid into which the whole dips.

In operation, this makes it possible to:

introduce air or some other gas into a liquid at a certain depth, the use of the sealed cylinder 16 as indicated in the drawing (FIG. 3) allowing a gas other than air to be used;

cause the entire volume of liquid to be set into motion.

By applying a rotational motion by means of an electric motor to the assembly thus formed and placed vertically in a liquid, the following actions will take place:

the water jet vacuum pumps will reach a certain speed in the liquid under the effect of the rotation of the shaft and of the water jet vacuum pumps fixed to the end, driven by the electric motor;

under the effect of the rotational speed of the set of water jet vacuum pumps, the liquid will reach a certain pressure on the tip 2 of the water jet vacuum pumps, and this will produce, at the outlet of the tips, a jet directed towards the outlet nozzle of each water jet vacuum pump 4, and this will give rise in the cavities 3 of each water jet vacuum pump to a depression which will be greater, the greater the speed of rotation, and therefore the higher the pressure on the tips of the water jet vacuum pumps.

This cavity in which the vacuum is created, situated at the periphery slightly set back from the outlet tip of each water jet vacuum pump, is connected to the hollow inside of the drive shaft, or to the space between the tube and the drive shaft, by a duct situated in the assembly and support piece between each water jet vacuum pump and the inside of the shaft, or the space between the tube and the shaft.

When the assembly is stationary, there is equilibrium of the liquid between the outside and the inside of the shaft, through which the air passes which travels as far as the water jet vacuum pumps when these are rotating.

When the assembly is put into operation, as soon as the pressure of the liquid on the tip of the water jet vacuum pumps has reached a certain magnitude, firstly, liquid inside the shaft assembly will be discharged as far as the cavities 3 of the water jet vacuum pumps, this discharge being brought about by the depression created by the jets at the outlet of the tips of the water jet vacuum pumps of the assembly. Once the liquid has been discharged, air or gas will be drawn up by the jets of liquid leaving the tip of the water jet vacuum pumps, and this air/liquid mixture is introduced into the liquid into which the assembly is dipped.

The greater the speed of rotation, the higher will be the pressure on the tip of the water jet vacuum pumps, the greater will be the depression obtained, and therefore the greater will be the flow rate of air or gas. It is therefore possible to vary the flow rate of air or gas introduced into the liquid as a function of the rotational speed of the whole.

The higher the speed of rotation, the higher will be the pressure on the tip of the water jet vacuum pumps, the greater will be the diffusion of air or gas, that is to say the smaller will be the air or gas bubbles, exhibiting a greater surface area for contact with the liquid, giving greater effectiveness.

This system affords very clear possibilities:

addition of air or gas to a liquid at a certain depth, therefore at a certain pressure, increasing the dissolution of the gas or air used; dimensioning of the apparatus as a function of the volume or of the flow rate of liquid into which the air or gas is to be injected;

the rotational motion of the apparatus and the addition of air or gas to the liquid will agitate the liquid, which will improve homogenization and contact of air or gas with the liquid;

the greater the rotational speed, the higher will be the pressure on the tip of the water jet vacuum pumps, the greater will be the depression obtained, the greater will be the flow rate of air or gas, and the more effective will be the diffusion of the air or gas into the liquid because the bubbles of air or gas will be smaller, exhibiting a greater surface area for contact with the liquid and therefore greater effectiveness;

the possibility of slaving the flow rate of air or gas injected to the flow rate of liquid passing through a volume by slaving the rotational speed of the set of water jet vacuum pumps to the flow rate of liquid passing through the volume;

increasing the mixing and agitation of the liquid by adding a set of fan blades to the drive shaft above the group of water jet vacuum pumps;

increasing the mixing and agitation of the liquid by incorporating the water jet vacuum pumps into the blades of a set of fan blades.

In order to introduce air or gas into a liquid, all that is required is to fix the complete apparatus equipped with an electric motor above the liquid, that end of the drive shaft which is equipped with the water jet vacuum pumps dipping down into the liquid, to connect the electric motor to a source of electrical energy, and to switch it on.

This system displays the following advantages:

the shaft and its equipment of water jet vacuum pumps which is associated with an electric motor forms an active assembly, without any mechanical parts in motion apart from the rotation of the shaft/water jet vacuum pumps assembly in the liquid;

there are no wearing components other than the shaft drive mechanism which is situated above the liquid, and therefore very accessible.

In order to increase the amount of air or gas to be introduced into the liquid, it is possible to place several water jet vacuum pumps in series on the same arm.

It is possible to introduce air or gas into the liquid at depth, by mounting several stages or sets of water jet vacuum pumps on the same shaft.

With the use of the sealed part 16 placed beneath the drive mechanism and dipping down into the liquid, forming a hydraulic seal, it is possible to inject any kind of gas, even a very oxidizing or corrosive gas into the liquid, the materials in contact with these gases being resistant to these gases or protected in order to allow them to be used.

While there have been shown and described what are present considered to be the preferred embodiments of the invention, it will be apparent to those skilled in the art that various changes and modifications can be made herein without departing from the scope of the invention as defined in the appended claims.

What I claim is:

1. An apparatus for diffusing a gas into a liquid at a certain depth, comprising a shaft having an axis, an upper end and a base, wherein the base is situated below the upper end:

a rotational drive member connected mechanically to the upper end of the shaft for driving the shaft;

a plurality of water jet vacuum pumps disposed in a liquid, wherein each of the plurality of water let vacuum pumps is fixedly attached to the base of the shaft at a distance from the axis of the shaft by a support, wherein said each of the plurality of water jet vacuum pumps includes an outlet nozzle disposed coaxially with a cone exhibiting a tip entered into the outlet nozzle and a cavity surrounding the tip of the cone and defining a vacuum volume, wherein the cavity is connected to a source of gas by a duct made in the support, whereby, when the shaft is rotated, a vacuum is created by said each of the plurality of water jet vacuum pumps to allow a gas from the gas source to flow through the duct to the vacuum volume and then into the liquid.

2. The apparatus according to claim 1, wherein said shaft is a hollow shaft having orifices made at its upper lateral part situated above a liquid level.

3. The apparatus according to claim 1, wherein said shaft is located inside a tube sealed at the base of the shaft.

4. The apparatus according to claim 1, wherein a set of fan blades is fixed to the shaft above the plurality of water jet vacuum pumps.

5. The apparatus according to claim 1, wherein several groups of water jet vacuum pumps are mounted along the shaft.

6. The apparatus according to claim 1 further comprising an enclosure fixed in a leaktight manner under said rotational drive member and dipping down into said liquid; and a gas nozzle connecting the source of gas to said enclosure.

7. The apparatus according to claim 1, wherein several water jet vacuum pumps are mounted on the support.

8. The apparatus according to claim 1, wherein several supports constitute blades of a set of fan blades.

9. The apparatus according to claim 1, wherein a flow rate of gas injected into the liquid is controlled by a rotation speed of the plurality of water jet vacuum pumps.

10. The apparatus according to claim 1, wherein the gas is air.

11. An apparatus for diffusing a gas into a liquid at a certain depth, comprising a rotary drive member;

a shaft having an axis, an upper end and a base, wherein the upper end of said shaft is mechanically connected to the rotary drive member;

a support means attached to the base of the shaft;

a first plurality of water jet vacuum pumps furnished to the base of the shaft, wherein each water jet vacuum pump of the first plurality of water jet vacuum pumps is arranged peripherally at a distance from the axis of the shaft and fixed to the shaft by the support means, said each water jet vacuum pump having a pump axis and including, coaxially, a cone aligned with the pump axis and exhibiting a tip at a narrowed end forming a jet, wherein a base of the cone forms an inlet of said each water jet vacuum pump, a chamber surrounding the tip and forming a cavity, and an outlet nozzle connected to the chamber on a side of the chamber disposed opposite to a side where the cone enters the chamber, wherein the narrowed end of the cone enters into the outlet nozzle;

a source of gas;

a conduit connecting the cavity to the source of gas by ducts furnished integrated with the support means of the water jet vacuum pumps, wherein a vacuum is created in the cavity by a liquid flowing through the cone when the shaft is rotated to allow a gas from the source of gas to flow through the conduit to the cavity and then into the liquid.

12. The apparatus of claim 11, wherein said shaft is a hollow shaft having orifices made at its upper lateral part situated above a liquid level, and wherein said hollow shaft furnishes a part of the conduit, and wherein said shaft is located inside a tube sealed at the base of the shaft.

13. The apparatus of claim 11, further comprising a set of fan blades fixed to the shaft above the first plurality of water jet vacuum pumps; and wherein the converging tube section is a cone having an axis, and wherein the axis of the cone is disposed perpendicular to a parallel of the axis of the shaft.

14. The apparatus of claim 11, further comprising a second plurality of water jet vacuum pumps mounted on the shaft and disposed at a different level along the axis of the shaft as compared to the first plurality of water jet vacuum pumps.

15. The apparatus of claim 11, further comprising an enclosure fixed in a leaktight manner under said rotary drive member and dipping down into said liquid;

a connection nozzle connecting the source of gas to said enclosure.

16. The apparatus of claim 11, further comprising a second plurality of water jet vacuum pumps mounted on one and the same support means; and a set of fan blades attached to the support means.

17. The apparatus of to claim 11, further comprising control means for a rotation speed of the support means for thereby controlling a flow rate of gas injected into the liquid based on the rotation speed of the shaft.

* * * * *